US006176302B1

(12) United States Patent
Takahashi et al.

(10) Patent No.: US 6,176,302 B1
(45) Date of Patent: Jan. 23, 2001

(54) BOILING HEAT TRANSFER TUBE

(75) Inventors: Hiroyuki Takahashi; Chikara Saeki, both of Hatano (JP)

(73) Assignee: Kabushiki Kaisha Kobe Seiko Sho, Kobe (JP)

( * ) Notice: Under 35 U.S.C. 154(b), the term of this patent shall be extended for 0 days.

(21) Appl. No.: 09/253,509

(22) Filed: Feb. 22, 1999

(30) Foreign Application Priority Data

Mar. 4, 1998 (JP) ..... 10-052562

(51) Int. Cl.[7] ..... F28F 13/18; F28F 1/42; F28F 1/36

(52) U.S. Cl. ..... 165/133; 165/179; 165/184

(58) Field of Search ..... 165/133, 184, 165/179

(56) References Cited

U.S. PATENT DOCUMENTS

| | | | | |
|---|---|---|---|---|
| 3,326,283 | * | 6/1967 | Ware | 165/133 |
| 4,166,498 | * | 9/1979 | Fujie et al. | 165/133 |
| 4,313,248 | * | 2/1982 | Fujikake | 165/133 |
| 4,660,630 | * | 4/1987 | Cunningham et al. | 165/133 |
| 5,186,252 | * | 2/1993 | Nishizawa et al. | 165/133 |
| 5,513,699 | * | 5/1996 | Menze et al. | 165/133 |
| 5,690,167 | * | 11/1997 | Rieger | 165/133 |

* cited by examiner

*Primary Examiner*—Ira S. Lazarus
*Assistant Examiner*—Tho Duong
(74) *Attorney, Agent, or Firm*—Oblon, Spivak, McClelland, Maier & Neustadt, P.C.

(57) ABSTRACT

In boiling heat transfer tube, fins 2 are provided on an outer surface of the tube body 1 in a manner such that the fins 2 each extend in a peripheral direction of the tube and a direction inclined to the tube axis at a pitch P2 in the tube axial direction. Protrusions 4 and recesses 5 are alternately formed in a length direction of a fin, a protrusion coming after a recess or vice versa, by being pressed. Opening 6 widths at the top ends of the cavity 3 between an adjacent pair of fins 2 are narrowed by inward jutting-out of the fins at both recesses 5 and protrusions 4. A profile of each of the protrusions in section perpendicular to the tube axis assumes a trapezoid. An opening width (W) between protrusions in section including the tube axis is 0.13 mm<W ≦0.40 mm, an angle (θ) formed between opposed side surfaces of each recess in section perpendicular to the tube axis is 55 degrees or less. A pitch (P1) of the recesses or the protrusions in section perpendicular to the tube axis is 0.28 mm≦P1≦0.55 mm. A pitch (P2) of the cavities in section including the tube axis is 0.50 mm≦P2≦0.90 mm. Ribs are provided on an inner surface of the tube body in a spiral fashion, wherein a rib lead angle (α) to the tube axis is 41 degrees≦α≦50 degrees, a rib height (h) is 0.22 mm≦h≦0.45 mm and a rib pitch (P3) in a tube axial direction is 2.6 mm≦P3≦6.5 mm.

8 Claims, 11 Drawing Sheets

BOILING HEAT TRANSFER TUBE

BACKGROUND OF THE INVENTION

1. Field of the Invention

The present invention relates to a boiling heat transfer tube which is incorporated in an flooded evaporator of a vapor compression refrigerating machine, such as a centrifugal type chiller, a screw type chiller, immersed in a liquid refrigerant (for example, freon, liquid nitrogen or the like) and used for heating and boiling a liquid refrigerant and particularly, to a boiling heat transfer tube which is improved on its heat transfer performance for a low density refrigerant.

2. Related Prior Art

Several kinds in shape of heat transfer surface have heretofore proposed as boiling heat transfer tubes of this kind. For example, as disclosed in the published Examined Japanese Patent Application Nos. Sho 53-25379 and Hei 4-78917, fins are formed on the outer surface of the tube, cuts to form holes are given in the tip of each fin and the tips of fins are turned down to form useful cavities for boiling heat transfer.

Besides, for example, as described in the published Examined Japanese Patent Application No. Sho 64-2878 and the published Unexamined Japanese Patent Application No. Hei 8-219674, after fins in a spiral fashion are formed on the outer surface of the tube, the tips of the fins are deformed by compression to form cavities in directions of a tube periphery and a tube axis and gaps of 0.13 mm or less in width are provided for communication between the cavities and the outside.

Furthermore, for example, as described in the published Unexamined Japanese Patent Application Nos. Hei 4-236097 and Hei 7-151485, in order to improve a heat transfer performance, not only is boiling in a cavity accelerated but turbulence of a liquid refrigerant and gasified refrigerant on the tube outer surface are also encouraged.

While these heat transfer tubes are improved in heat transfer performance when a refrigerant, such as trichlorofluoromethane, chlorodifluoromethane, or 1,1-dichloro-2,2,trifluoroethane, is used, there has been a problem, when a low density refrigerant, such as 1,1,2-tetrafluoroehtane is used, that a heat transfer performance is reduced since a conventional heat transfer tube has a small opening (a gap) where a cavity and the outside are communicated, which resists flowing-in of a liquid refrigerant into the cavity, and makes a space in the cavity dried.

In order to avoid this problem, a method can be considered that a quantity of a liquid refrigerant charged in a flooded evaporator is increased, but it has a fault that a charge cost of a liquid refrigerant is increased and in addition, a requirement arises that a volume of an heat exchanger is larger, which in turn makes a cost further increased.

SUMMARY OF THE INVENTION

The present invention was made in light of the above problems and it is, accordingly, an object of the present invention to provide a boiling heat transfer tube which can improve its heat transfer performance when a low density refrigerant is used.

A boiling heat transfer tube according to the present invention comprises: a heat transfer tube body; and fins formed on an outer surface of the tube body in a specified pitch along an axial direction thereof while being disposed in an extending manner along tube peripheral directions, wherein each of fins has recesses and protrusions disposed alternately, a protrusion coming after a recess or vice versa, along its length direction and an opening width (W) between protrusions of adjacent fins is 0.13 mm<W≦0.40 mm.

In the boiling heat transfer tube, it is preferred that an opening width at a top end of a cavity between an adjacent pair of the fins is narrowed by mutual, inward jutting-out of the fins at either recesses or protrusions.

Besides, a profile of each of the protrusions in section perpendicular to the tube axis can assume a trapezoid. It is preferred that in section perpendicular to the tube axis, an angle (θ) formed between opposed side surfaces of each recess is 55 degrees or less; in section perpendicular to the tube axis, a pitch (P1) of the recesses or the protrusions in a peripheral direction is 0.28 mm≦P1≦0.55 mm; or in section including the tube axis, a pitch (P2) of the cavities is 0.50 mm≦P2<0.90 mm. Furthermore, it is preferred that ribs are provided on an inner surface of the tube body in a spiral fashion, wherein a lead angle (α) of a rib to the tube axis is 41 degrees≦α≦50 degrees, a rib height (h) is 0.22 mm≦h≦0.45 mm and a pitch (P3) of the ribs in a tube axial direction is 2.6 mm≦P3≦6.5 mm.

DETAILED DESCRIPTION OF THE INVENTION

Figure 1:
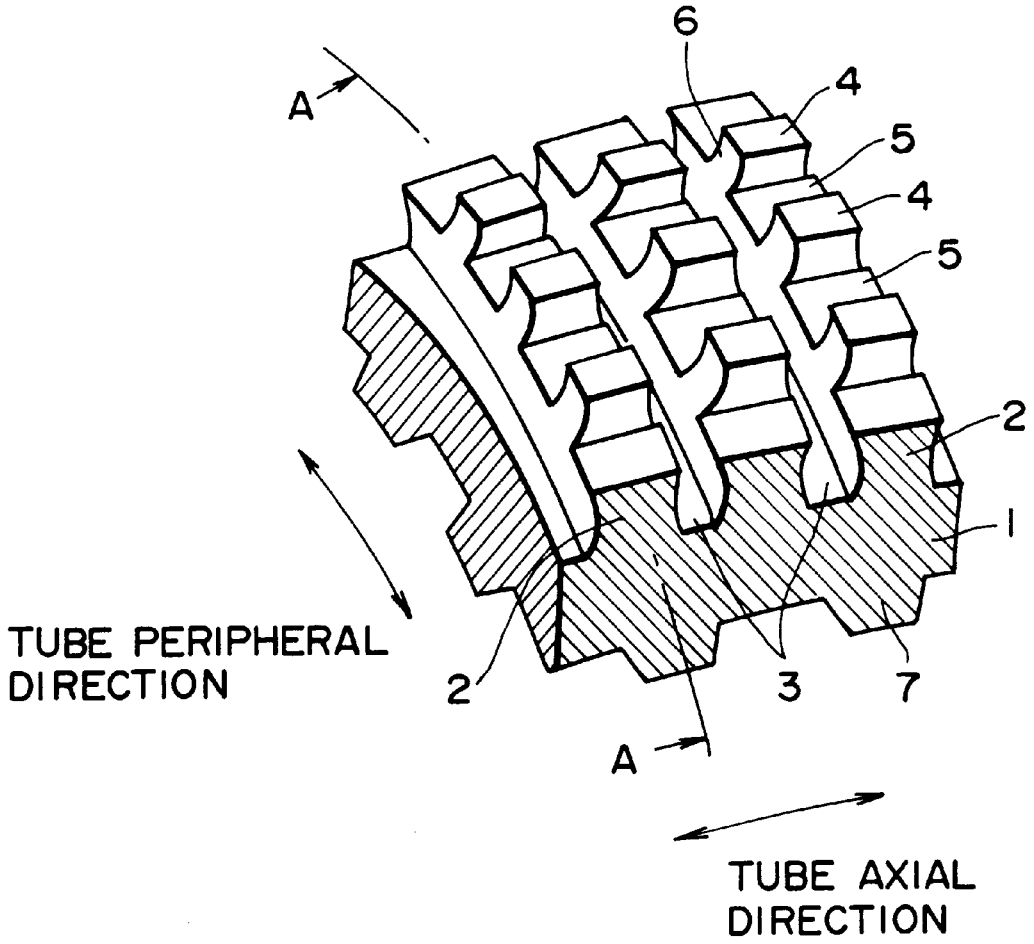
FIG. 1 is a perspective view showing a boiling heat transfer tube pertaining to an embodiment of the present invention.
Figure 2:
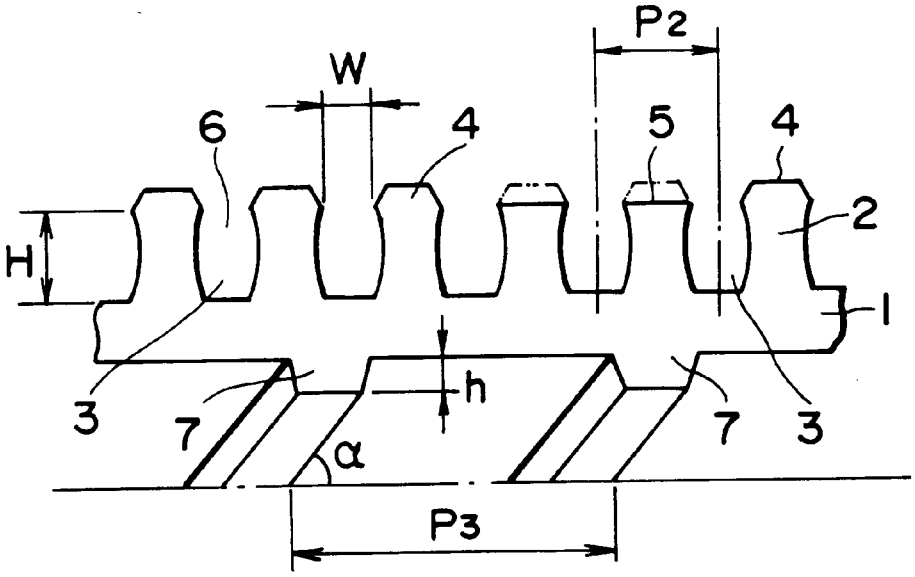
FIG. 2 is a sectional view taken on the tube axis in the embodiment.
Figure 3:
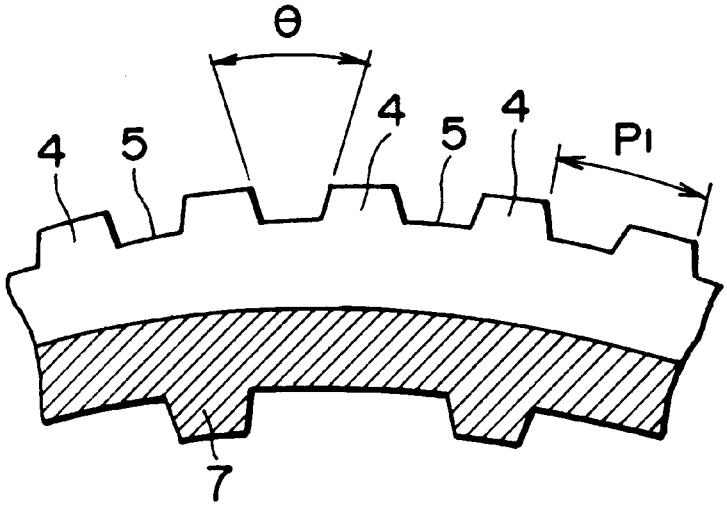
FIG. 3 is a sectional view taken on a direction (line A—A of FIG. 1) perpendicular to the tube axis in the embodiment.

Below, an embodiment of the present invention will be in a concrete manner described in reference to the accompanying drawings. FIG. 1 is a perspective view showing a boiling heat transfer tube pertaining to an embodiment of the present invention, FIG. 2 is a sectional view taken on the tube axis and FIG. 3 is a sectional view taken on a direction perpendicular to the tube axis. Fins 2 are provided on an outer surface of a tube body 1 in a manner such that each of the fin 2 extends in a direction inclined to the tube axis. The fins 2 extend in a spiral fashion along the axial direction at a pitch P2 (see FIG. 2). Protrusions 4 and recesses 5 are alternately formed in a length direction of a fin, a protrusion coming after a recess or vice versa, by being intermittently pressed with a gear or the like. A fin 2 may be one which extends in a direction perpendicular to the tube axis.

As shown in FIG. 2, a cavity 3 is formed between a pair of adjacent fins 2 and opposed top ends of protrusions 4, and opposed bottoms of recesses 5 of the pair of adjacent fins 5 respectively jut out toward each other at openings 6 of the cavity 3 at top ends thereof to narrow the openings 6. In a section taken on the axis, an opening 6 width between the protrusions 4 is W. A cavity 3 pitch is P2 same as a pitch of the fins.

On the other hand, as shown in FIG. 3, a pitch of protrusions 4 along the tube peripheral direction is P1 in a section taken on a direction perpendicular to the tube axis. An angle formed between opposed side surfaces of a recess 5 is θ.

As shown in FIG. 2, ribs 7 extending along the axis direction in a spiral fashion on the inner surface of the tube body 1 is formed. A lead angle of a rib 7 is α and a pitch of the ribs 7 along the axis direction is P3 and a height of a rib 7 is h.

In the boiling heat transfer tube which has a structure like this, gas bubbles generated in a cavity 3 are discharged from the opening 6 between protrusions 4 and a necessary quantity of a liquid refrigerant flows into the cavity 3 through the opening 6 between recesses 5 because of a recess/protrusion fashion of the top contour of a fin 2.

The bottom portions of adjacent recesses 5 jut out in an opposed manner along a tube axial direction over the cavity 3 therebetween at the opening 6 and the jutting-outs are desirably set in length so as not to be put in contact with each other. By the jutting-out of both recess 5 bottoms, bubbles in the cavity 3 are disturbed when being released from the opening 6 and thereby boiling is accelerated.

Even when the jutting-outs of the bottom portions of recesses 5 are provided, it is preferred that the width (W) of the opening 6 between the top ends of protrusions 4 is in the range of 0.13 mm≦W≦0.40 mm. When a width W of the opening 6 is 0.13 mm or less, a bubble is hard to be released from inside the cavity 3, a space in the cavity gets dried and as a result, a heat transfer performance is reduced. On the other hand, when a width W of the opening 6 is more than 0.40 mm, a bubble inside the cavity is easy to be released and besides, a liquid refrigerant is also easy to flow into the cavity 3, whereby a heat transfer performance is again reduced.

When the opening 6 between protrusions 4 is enlarged along the tube axial direction, a bubble generated inside the cavity 3 between the protrusions 4 is encouraged when the bubble is released from the cavity 3.

When a protrusion 4 has the profile of a trapezoid in section perpendicular to the tube axis, at a protrusion 4 a bubble is especially easy to be released at the upper end of a trapezoidal profile (narrower end) while at a recess 5 a liquid flows in at the bottom portion thereof (narrower spatial portion near the cavity 3). Hence, even if a width of the opening is not narrow, efficiencies of bubble release from inside a cavity and flowing-in of a liquid refrigerant into the cavity are improved and thereby boiling is accelerated. At this point, when an angle (θ) between opposed sides of a recess is more than 55 degrees, a liquid refrigerant is easy to flow into a cavity, which entails reduction in heat transfer performance.

It is preferred that in section perpendicular to the tube axis, a pitch (P1) of recesses or protrusions in a tube peripheral direction is in the range of 0.28 mm≦P1≦0.55 mm. When the pitch is less than 0.28 mm, a liquid refrigerant is hard to flow into a cavity and thereby, not only does a space inside the cavity get dried but a heat transfer performance is also reduced. When the pitch P1 is more than 0.55 mm, a liquid refrigerant is easy to flow into the cavity and as a result, a heat transfer performance is reduced.

It is preferred that a pitch (P2) of cavities 3 along the tube axial direction is in the range of 0.50 mm≦P2≦0.90 mm. When the pitch P2 is less than 0.50 mm, the cavities 3 are narrower and thereby a liquid refrigerant is hard to flow into the cavities 3, which entails reduction in heat transfer performance. When the pitch P2 is larger than 0.90 mm, cavities in each unit length of tube is fewer, which also entails reduction in heat transfer performance.

It is preferred that ribs 7 provided on an inner surface of a tube in a spiral fashion have a lead angle (α) to the tube axial direction in the range of 41 degrees≦α≦50 degrees, a rib height (h) in the range of 0.22 mm≦h≦0.45 mm and a pitch (P3) along the tube axial direction in the range of 2.6 mm≦P3≦6.5 mm.

When a rib lead angle (α) to the tube axis is less than 41 degrees, a liquid near the inner surface of the tube receives a small disturbing effect. Hence, a liquid refrigerant flowing into the cavities 3 is hard to be boiled by heating and therefore, an effect of improving a heat transfer performance is small. On the other hand, when the lead angle (α) is more than 50 degrees, a pressure loss near the inner surface of the tube is increased and a pump power is thus increased, which naturally entails a poor efficiency.

When a rib height h is less than 0.22 mm, a disturbing effect which a liquid near the inner surface of the tube receives is small and therefore, a liquid flowing into a cavity is hard to be boiled, which entails small improvement on heat transfer performance. On the other hand, when a rib height h is more than 0.45 mm, a space in a cavity is easy to be dried, which, in turn, makes not only a heat transfer performance reduced but a pressure loss increased, and as a result, pump power for chilled water is increased.

When a rib pitch P3 is equal to or less than 2.6 mm, a disturbing effect on a liquid near the inner surface of the tube is smaller and therefore, a heat transfer performance is hard to be increased. On the other hand, the pitch P3 is more than 6.5 mm, a velocity boundary layer and a thermal boundary layer are created in the liquid near the inner surface of the tube, which entails small increase in heat transfer performance.

While a substance of a heat transfer tube is generally copper or copper alloy, the present invention can be carried out with the same effect when a metal other than copper or its alloy is used as the substance.

EXAMPLES

Then, boiling heat transfer tubes pertaining to an embodiment of the present invention were manufactured and characteristics thereof were evaluated. Testing conditions for heat transfer performances of the boiling heat transfer tubes evaluated are shown in Table 1 below.

TABLE 1

Testing Conditions for Heat Transfer Performance

| | |
|---|---|
| Refrigerant | 1, 1, 1, 2 - tetrafluoroethane |
| Evaporation Pressure | 5.8342 kgf/cm$^2$ abs |

TABLE 1-continued

| Testing Conditions for Heat Transfer Performance | |
|---|---|
| Evaporating Temperature | 12° C. |
| Water Flow Velocities | 1.0 ~ 3.0 m/s (FIG. 5)<br>2.0 m/s (FIGS. 6 ~ 12) |
| Water Inlet Temperature | 22° C. |

Figure 4:
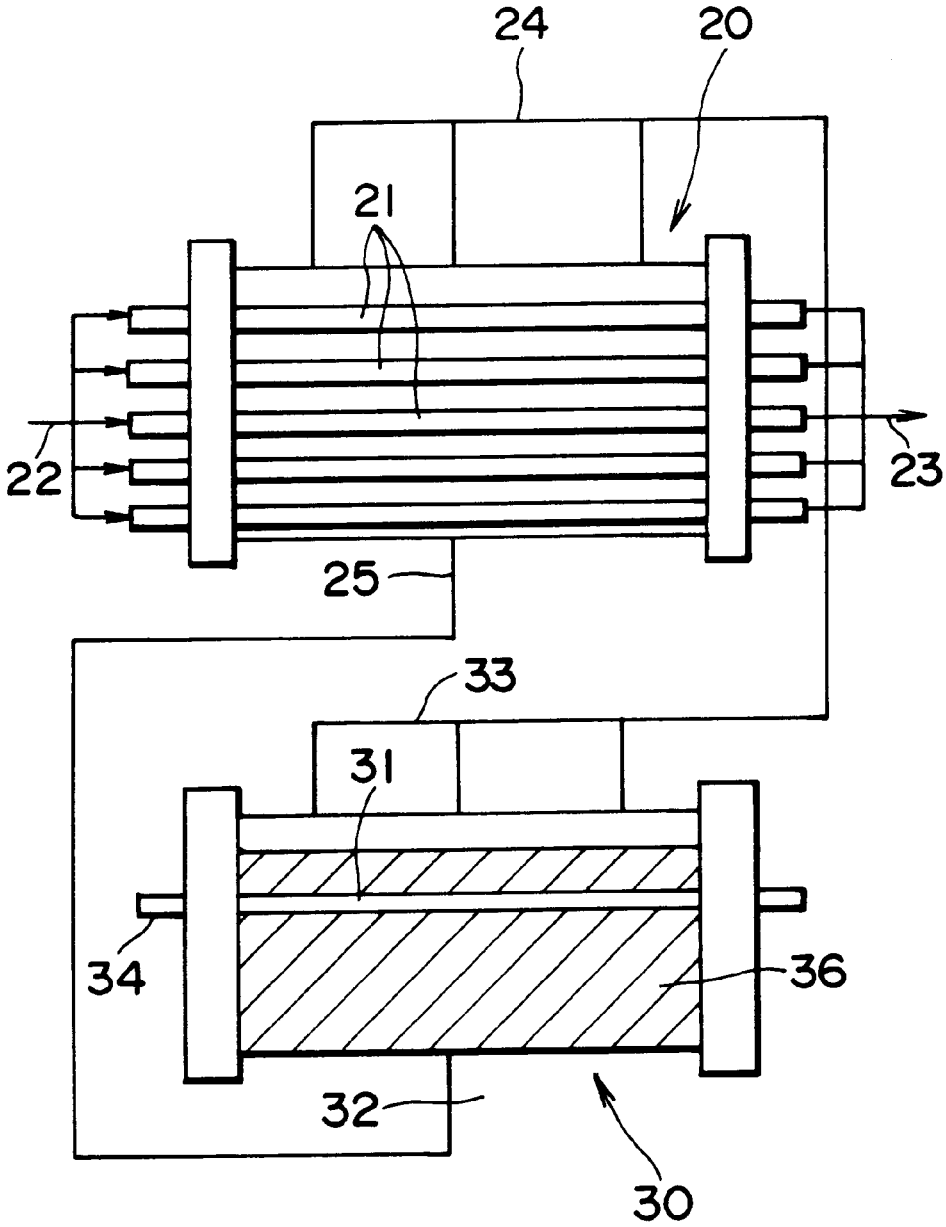
FIG. 4 is a view showing a testing device of the embodiment.

Then, a testing device and a testing method will be described. FIG. 4 is a view showing the testing device for evaluation of heat transfer performance. The condenser 20 has a structure that a plurality of heat transfer tubes 21 are vertically disposed while axial directions of the tubes 21 are horizontally kept. Cooling water is fed into the heat transfer tubes 21 from an inlet 22 and the cooling water is discharged through an outlet 23. Refrigerant vapor is fed to the peripheral spaces of the heat transfer tubes 21 from an inlet 24 above the heat transfer tubes 21 and condensed liquid refrigerant is sent to an evaporator 30 from an outlet 25.

In the flooded evaporator 30, a specimen tube 31 to be tested is immersed in refrigerant 36 with the tube axial direction kept horizontally, liquid refrigerant is supplied from an inlet 32 disposed below the flooded evaporator 30, refrigerant vapor produced by heating from the specimen tube 31 is discharged from an outlet 33 disposed above the flooded evaporator 30 and thereafter, the refrigerant vapor is fed to the refrigerant vapor inlet 24 of the evaporator 20. In the specimen tube 31, water is fed from an inlet 34 and the water is discharged through an outlet 35 after the cooling.

The testing device constructed in such a manner has a structure that the condenser 20, a shell and tube type heat exchanger, and the flooded evaporator 30 are connected by piping, wherein refrigerant vapor generated at the flooded evaporator 30 is guided to the condenser 20 through the inlet 24 in piping above the flooded evaporator, the refrigerant vapor is condensed on the surfaces of the heat transfer tubes 21 by passing cooling water through the heat transfer tubes 21 in the condenser 20 and thus condensed refrigerant is returned back to the flooded evaporator through piping under the condenser.

The testing method was carried out as follows. Water was made to flow into the specimen tube 31 disposed in the flooded evaporator 30 at a constant flow rate and an inlet temperature of the water was adjusted so to be kept constant. On the other hand, an evaporation pressure was adjusted so as to assume a testing condition by changing a cooling water flow rate through the heat transfer tubes in the condenser 20. After the water flow rate, outlet and inlet temperatures and evaporation pressure established stable states at respective specified conditions, measurements were performed.

Figure 5:
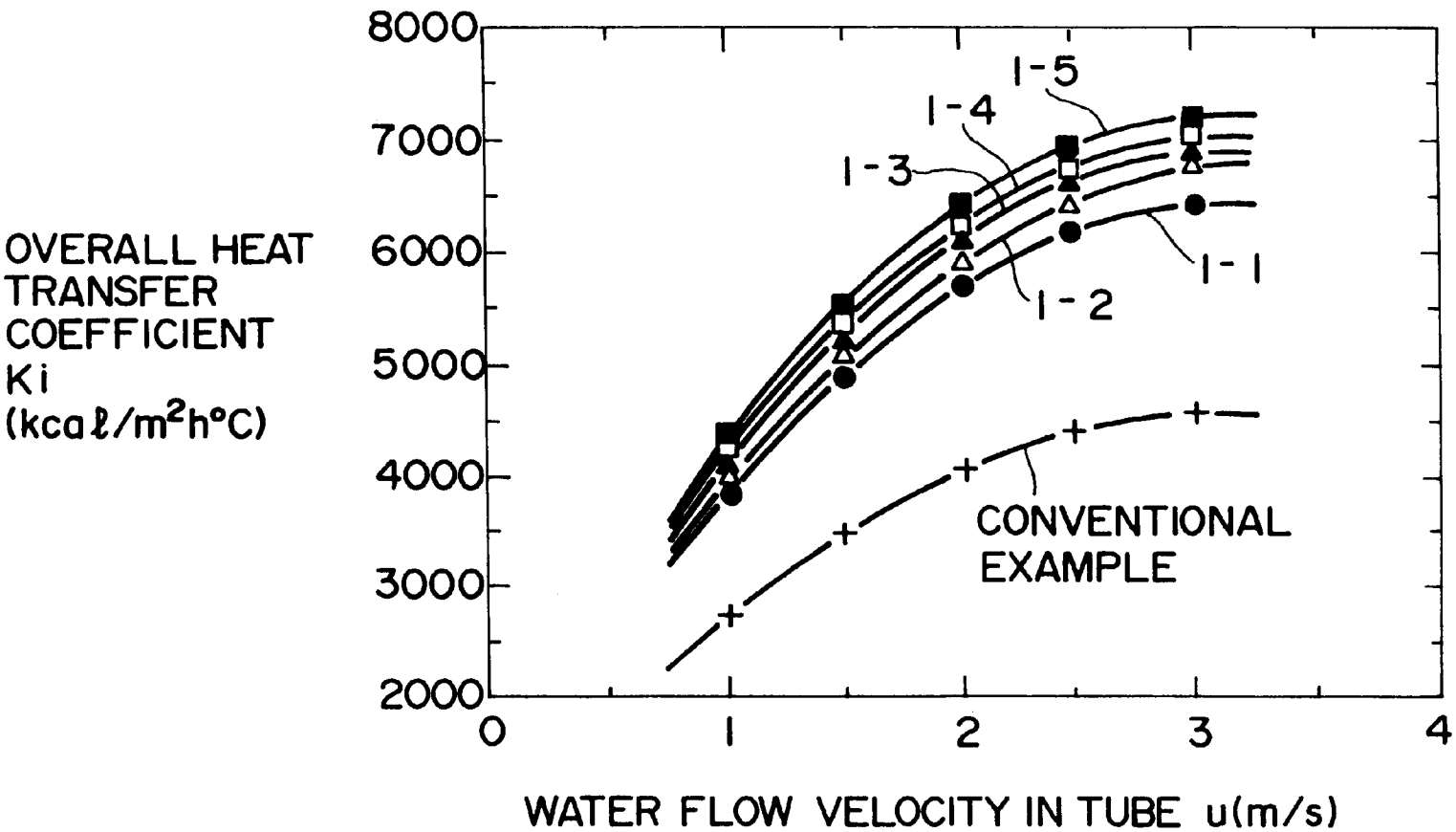
FIG. 5 is a graph showing a relation between a water flow velocity in the tube and an overall heat transfer coefficient.
Figure 6:
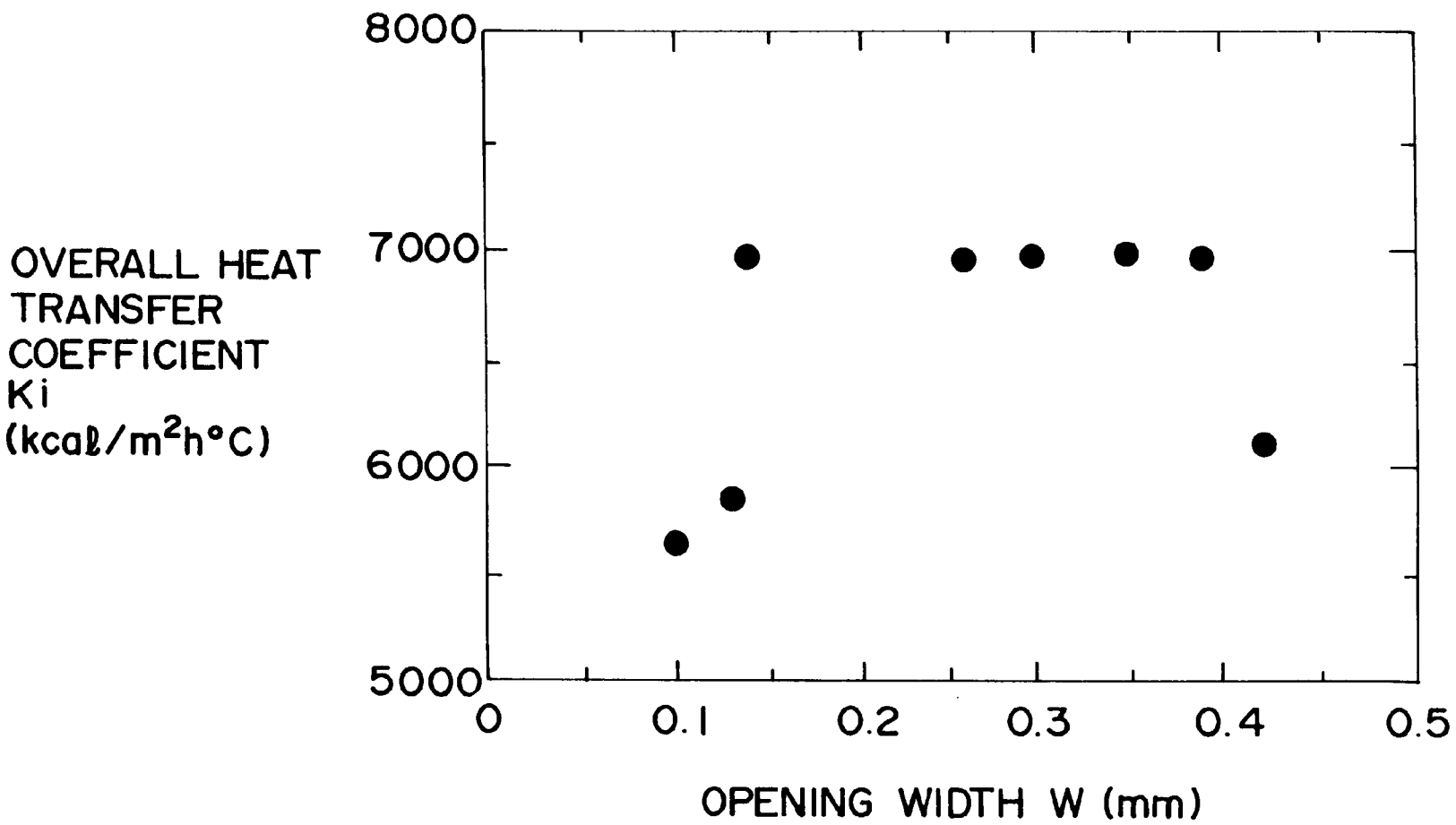
FIG. 6 is a graph showing a relation between an opening width W and an overall heat transfer coefficient.
Figure 7:
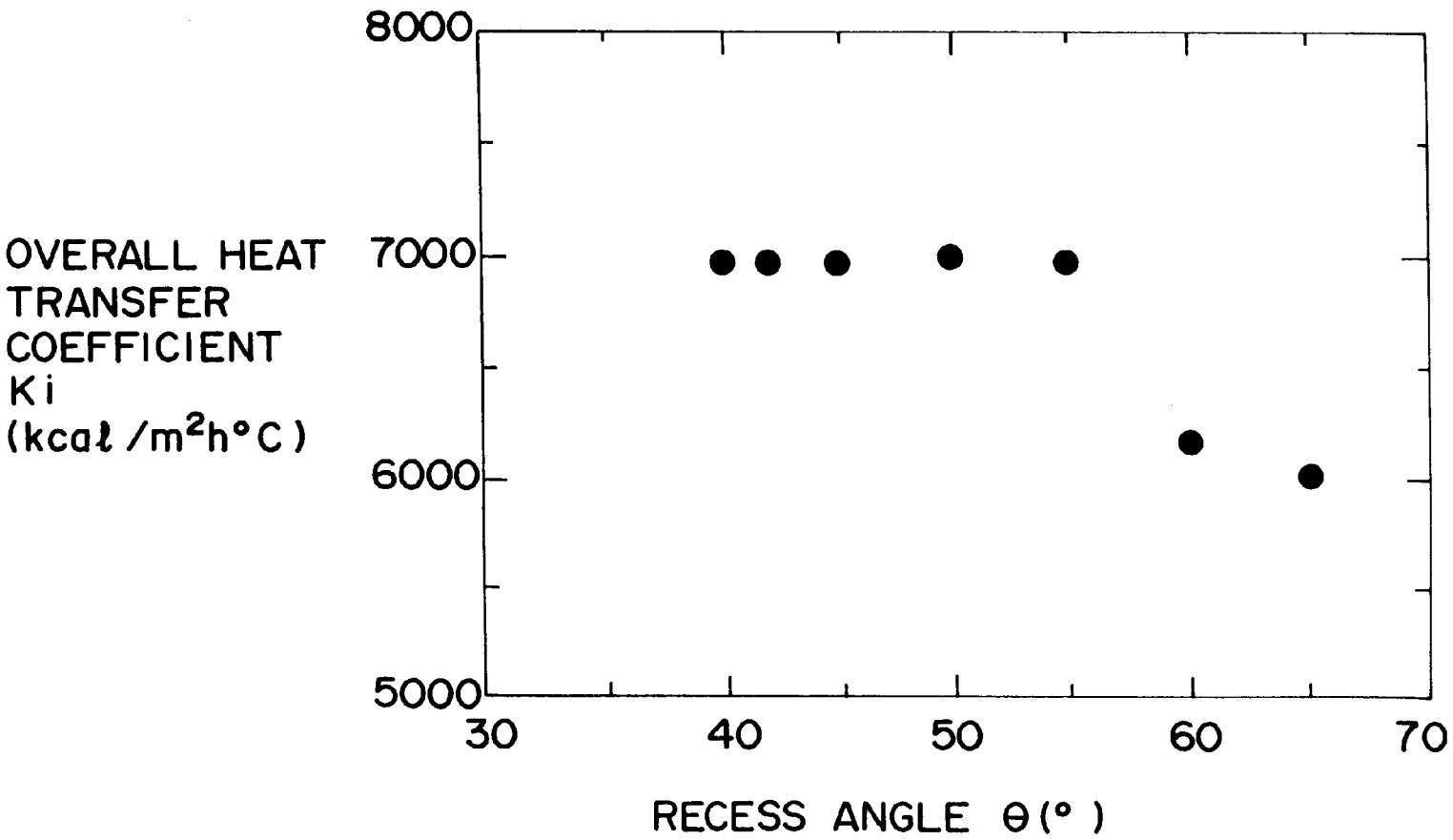
FIG. 7 is a relation between an angle (θ) formed between opposed side surfaces of a recess and an overall heat transfer coefficient.
Figure 8:
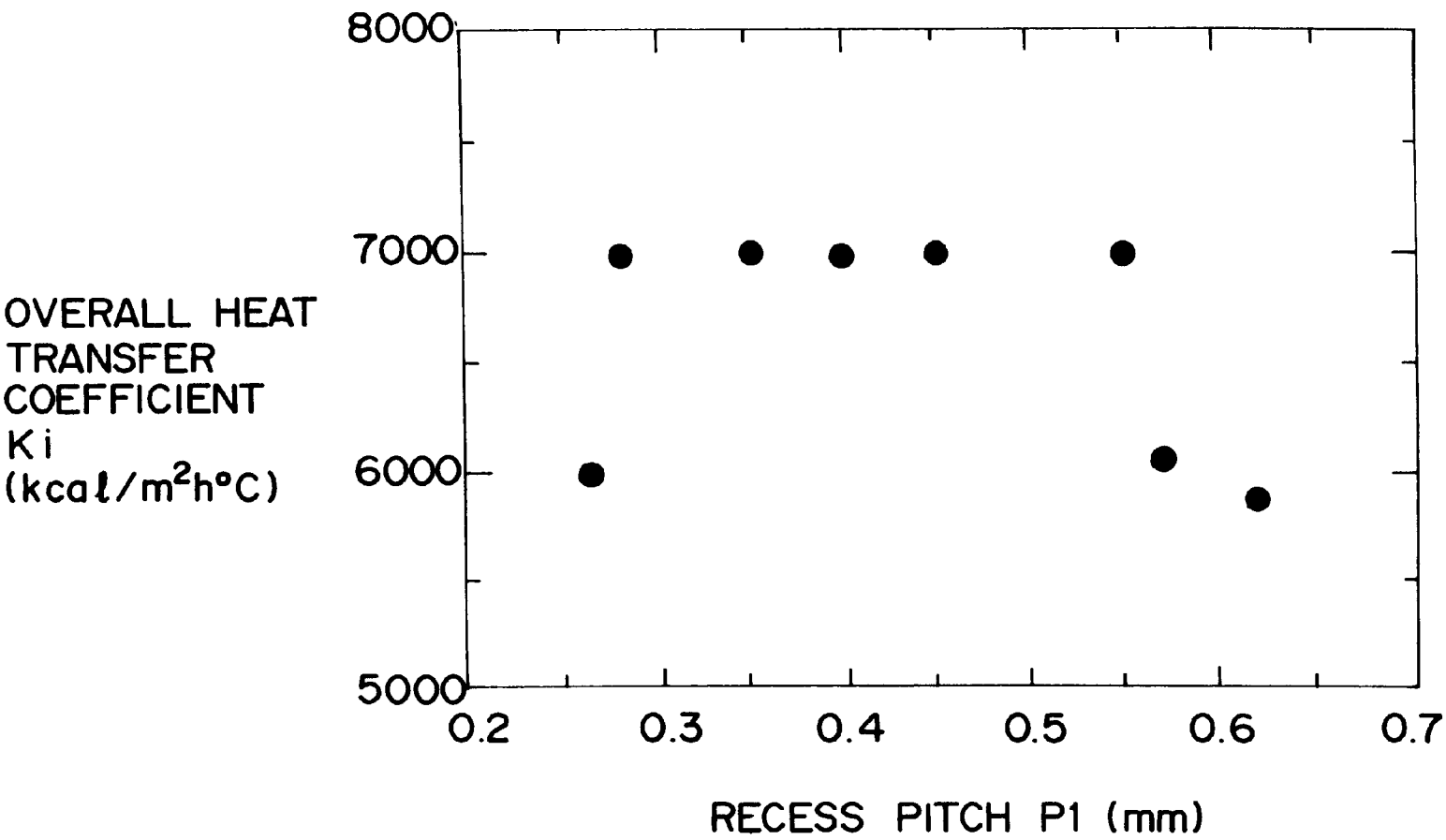
FIG. 8 is a graph showing a recess pitch P1 and an overall heat transfer coefficient.
Figure 9:
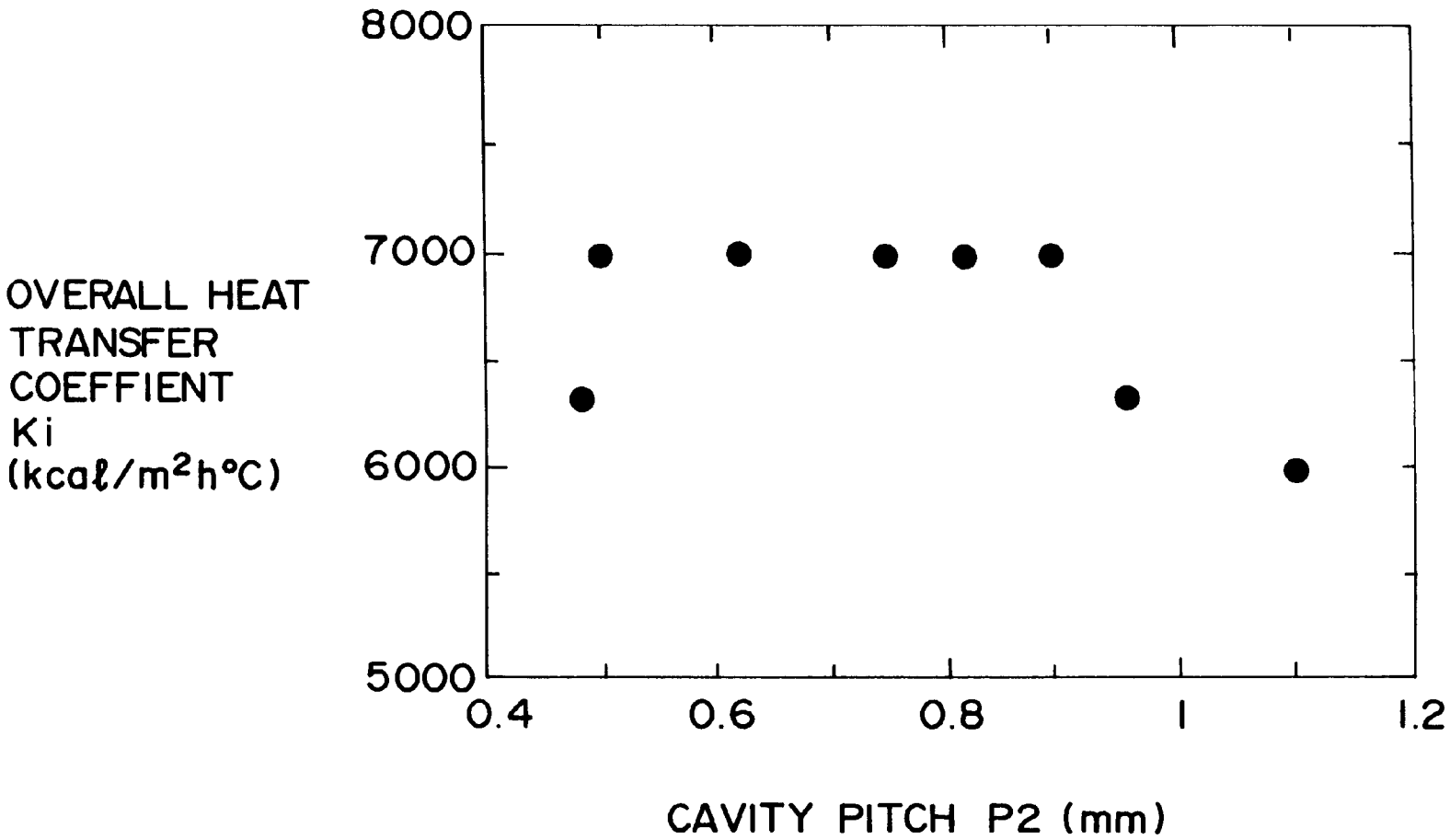
FIG. 9 is a graph showing a cavity pitch P2 and an overall heat transfer coefficient.
Figure 10:
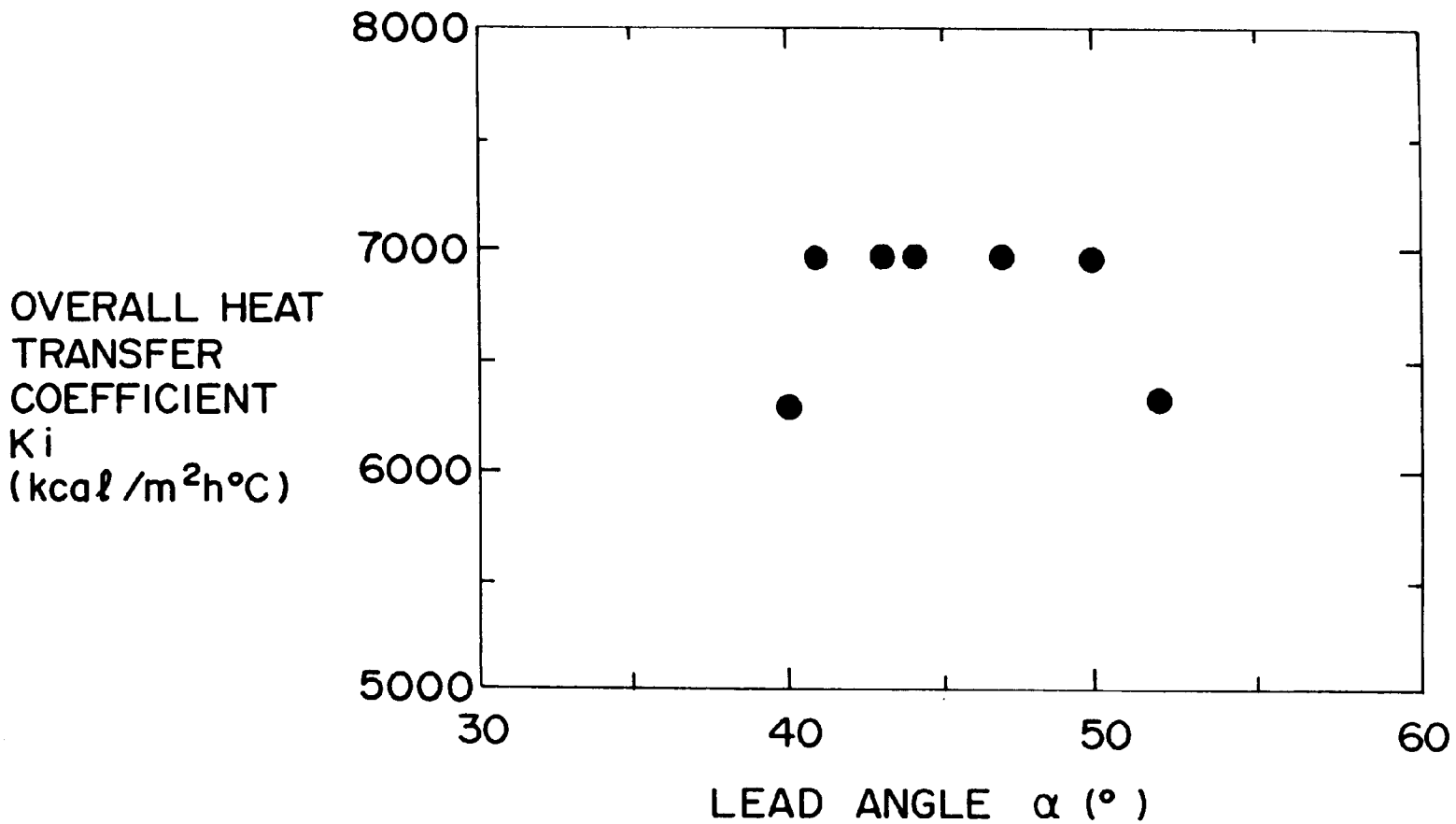
FIG. 10 is a graph showing a rib lead angle α and an overall heat transfer coefficient.
Figure 11:
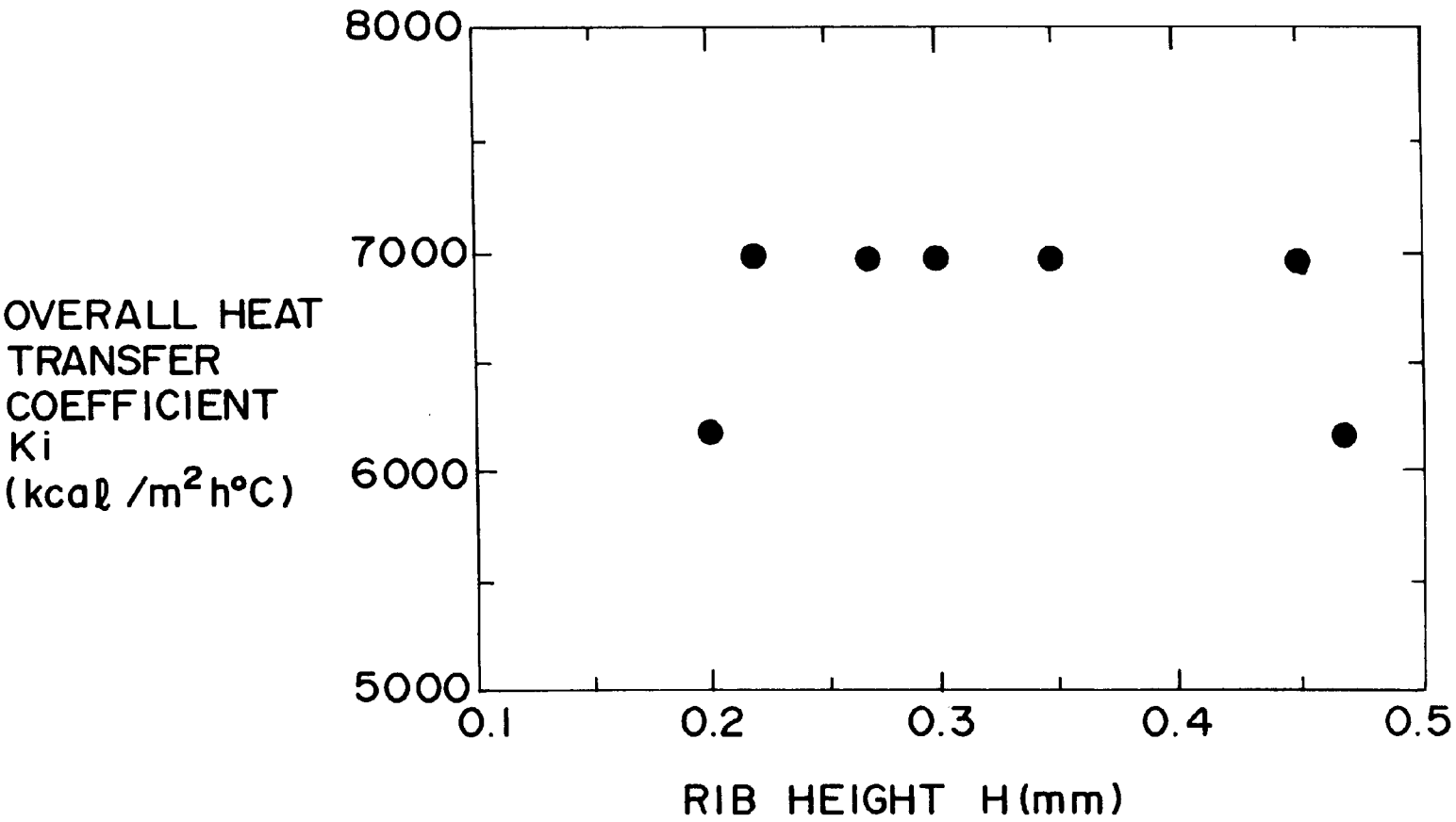
FIG. 11 is a graph showing a rib height h and an overall heat transfer coefficient.
Figure 12:
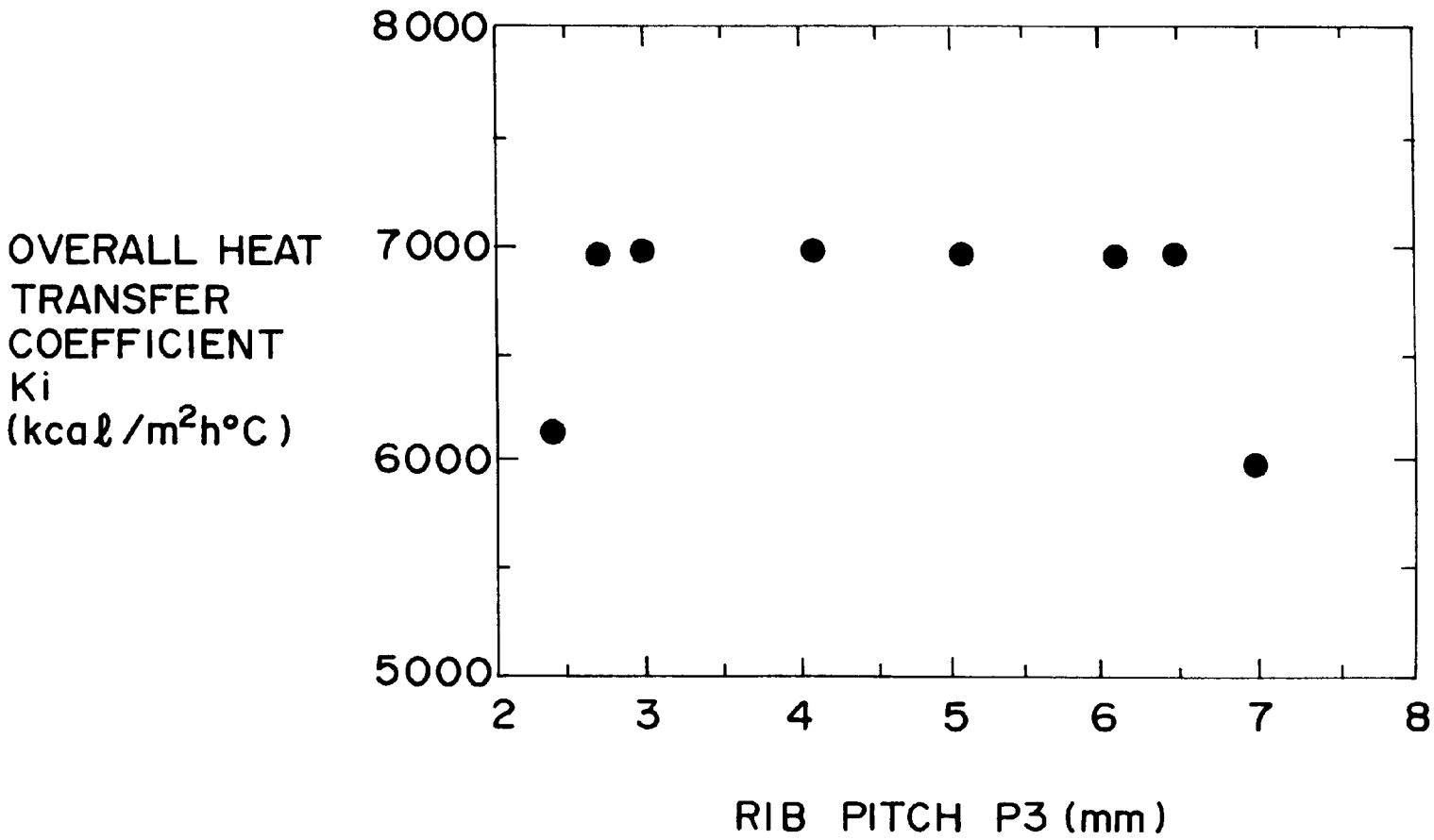
FIG. 12 is a graph showing a rib pitch P3 and an overall heat transfer coefficient.

FIG. 5 is comparative results between examples 1~5 (1-1~5) and a low-fin tube with 26 fins per inch as a conventional example in overall heat transfer coefficients using a tube end smooth inner surface for the calculation vs. coolant water flow velocities.

FIGS. 6 to 12 shows overall heat transfer coefficients of a tube end smooth inner surface as reference for respective variables of an opening width W, a recess angle θ, a recess pitch P1, a cavity pitch P2, a lead angle α, a rib height h and a rib pitch P3. Data are shown in Tables 2 to 10 below. In Tables 2 to 10, Test Nos. 1-1~1-34 satisfy all the conditions defined in all claims claimed in the present application and Test Nos. 2-1~2-1~2-17 do not satisfy one of all the claims. For example, Test Nos. 2-1~2-3 do not satisfy the limitation of W, Test Nos. 2-4~2-5 do not satisfy the limitation of θ, Test Nos. 2-6~2-8 do not satisfy the limitation of P1, and Test Nos. 2-9~2-11 do not satisfy the limitation of P2. Test Nos. 2-12~2-13 do not satisfy the limitation of α, Test Nos. 2-14~2-15 do not satisfy the limitation of h, and Test Nos. 2-16~2-17 do not satisfy the limitation of P3.

As seen from the figures and tables, Test Nos. 1-1~1-34 shows higher overall heat transfer coefficients as compared with Test Nos. 2-1~2-17.

TABLE 2

| No | do tube end outside diameter mm | t tube end thickness mm | df fined section outside diameter mm | H cavity height mm | W opening width mm | θ recess angle | P1 recess pitch mm | P2 cavity pitch mm |
|---|---|---|---|---|---|---|---|---|
| 1-1 | 19.05 | 1.19 | 18.44 | 0.54 | 0.30 | 45 | 0.40 | 0.75 |
| 1-2 | 19.05 | 1.19 | 18.45 | 0.55 | 0.29 | 45 | 0.40 | 0.74 |
| 1-3 | 19.05 | 1.19 | 18.43 | 0.56 | 0.30 | 45 | 0.40 | 0.75 |
| 1-4 | 19.05 | 1.19 | 18.46 | 0.54 | 0.30 | 45 | 0.40 | 0.75 |
| 1-5 | 19.05 | 1.19 | 18.45 | 0.55 | 0.30 | 45 | 0.40 | 0.75 |
| 1-6 | 19.05 | 1.19 | 18.45 | 0.55 | 0.14 | 45 | 0.40 | 0.75 |
| 1-7 | 19.05 | 1.19 | 18.46 | 0.56 | 0.26 | 45 | 0.40 | 0.75 |
| 1-8 | 19.05 | 1.19 | 18.45 | 0.54 | 0.35 | 45 | 0.40 | 0.75 |
| 1-9 | 19.05 | 1.19 | 18.44 | 0.55 | 0.39 | 45 | 0.40 | 0.76 |
| 1-10 | 19.05 | 1.19 | 18.45 | 0.55 | 0.30 | 55 | 0.40 | 0.75 |
| 1-11 | 19.05 | 1.19 | 18.45 | 0.56 | 0.30 | 50 | 0.40 | 0.75 |
| 1-12 | 19.05 | 1.19 | 18.45 | 0.55 | 0.30 | 42 | 0.40 | 0.75 |
| 1-13 | 19.05 | 1.19 | 18.45 | 0.55 | 0.30 | 40 | 0.40 | 0.75 |
| 1-14 | 19.05 | 1.19 | 18.45 | 0.55 | 0.30 | 45 | 0.28 | 0.75 |
| 1-15 | 19.05 | 1.19 | 18.45 | 0.55 | 0.30 | 45 | 0.35 | 0.75 |
| 1-16 | 19.05 | 1.19 | 18.45 | 0.55 | 0.30 | 45 | 0.45 | 0.75 |
| 1-17 | 19.05 | 1.19 | 18.45 | 0.55 | 0.30 | 45 | 0.55 | 0.75 |

TABLE 3

| No | do tube end outside diameter mm | t tube end thickness mm | df fined section outside diameter mm | H cavity height mm | W opening width mm | θ recess angle | P1 recess pitch mm | P2 cavity pitch mm |
|---|---|---|---|---|---|---|---|---|
| 1-18 | 19.05 | 1.19 | 18.45 | 0.55 | 0.30 | 45 | 0.40 | 0.50 |
| 1-19 | 19.05 | 1.19 | 18.45 | 0.55 | 0.30 | 45 | 0.40 | 0.62 |
| 1-20 | 19.05 | 1.19 | 18.45 | 0.55 | 0.30 | 45 | 0.40 | 0.82 |
| 1-21 | 19.05 | 1.19 | 18.45 | 0.55 | 0.30 | 45 | 0.40 | 0.90 |
| 1-22 | 19.05 | 1.19 | 18.45 | 0.55 | 0.30 | 45 | 0.40 | 0.75 |
| 1-23 | 19.05 | 1.19 | 18.45 | 0.55 | 0.30 | 45 | 0.40 | 0.75 |
| 1-24 | 19.05 | 1.19 | 18.45 | 0.55 | 0.30 | 45 | 0.40 | 0.75 |
| 1-25 | 19.05 | 1.19 | 18.45 | 0.55 | 0.30 | 45 | 0.40 | 0.75 |
| 1-26 | 19.05 | 1.19 | 18.45 | 0.55 | 0.30 | 45 | 0.40 | 0.75 |
| 1-27 | 19.05 | 1.19 | 18.45 | 0.55 | 0.30 | 45 | 0.40 | 0.75 |
| 1-28 | 19.05 | 1.19 | 18.45 | 0.55 | 0.30 | 45 | 0.40 | 0.75 |
| 1-29 | 19.05 | 1.19 | 18.45 | 0.55 | 0.30 | 45 | 0.40 | 0.75 |
| 1-30 | 19.05 | 1.19 | 18.45 | 0.55 | 0.30 | 45 | 0.40 | 0.75 |
| 1-31 | 19.05 | 1.19 | 18.45 | 0.55 | 0.30 | 45 | 0.40 | 0.75 |
| 1-32 | 19.05 | 1.19 | 18.45 | 0.55 | 0.30 | 45 | 0.40 | 0.75 |
| 1-33 | 19.05 | 1.19 | 18.45 | 0.55 | 0.30 | 45 | 0.40 | 0.75 |
| 1-34 | 19.05 | 1.19 | 18.45 | 0.55 | 0.30 | 45 | 0.40 | 0.75 |

TABLE 4

| No | do tube end outside diameter mm | t tube end thickness mm | df fined section outside diameter mm | H cavity height mm | W opening width mm | θ recess angle | P1 recess pitch mm | P2 cavity pitch mm |
|---|---|---|---|---|---|---|---|---|
| 2-1 | 19.05 | 1.19 | 18.45 | 0.55 | 0.13 | 45 | 0.40 | 0.75 |
| 2-2 | 19.05 | 1.19 | 18.45 | 0.55 | 0.10 | 45 | 0.40 | 0.75 |
| 2-3 | 19.05 | 1.19 | 18.45 | 0.55 | 0.42 | 45 | 0.40 | 0.75 |
| 2-4 | 19.05 | 1.19 | 18.45 | 0.55 | 0.30 | 60 | 0.40 | 0.75 |
| 2-5 | 19.05 | 1.19 | 18.45 | 0.55 | 0.30 | 65 | 0.40 | 0.75 |
| 2-6 | 19.05 | 1.19 | 18.45 | 0.55 | 0.30 | 45 | 0.26 | 0.75 |
| 2-7 | 19.05 | 1.19 | 18.45 | 0.55 | 0.30 | 45 | 0.57 | 0.75 |
| 2-8 | 19.05 | 1.19 | 18.45 | 0.55 | 0.30 | 45 | 0.62 | 0.75 |
| 2-9 | 19.05 | 1.19 | 18.45 | 0.55 | 0.30 | 45 | 0.40 | 0.48 |
| 2-10 | 19.05 | 1.19 | 18.45 | 0.55 | 0.30 | 45 | 0.40 | 0.96 |
| 2-11 | 19.05 | 1.19 | 18.45 | 0.55 | 0.30 | 45 | 0.40 | 1.10 |
| 2-12 | 19.05 | 1.19 | 18.45 | 0.55 | 0.30 | 45 | 0.40 | 0.75 |
| 2-13 | 19.05 | 1.19 | 18.45 | 0.55 | 0.30 | 45 | 0.40 | 0.75 |
| 2-14 | 19.05 | 1.19 | 18.45 | 0.55 | 0.30 | 45 | 0.40 | 0.75 |
| 2-15 | 19.05 | 1.19 | 18.45 | 0.55 | 0.30 | 45 | 0.40 | 0.75 |
| 2-16 | 19.05 | 1.19 | 18.45 | 0.55 | 0.30 | 45 | 0.40 | 0.75 |
| 2-17 | 19.05 | 1.19 | 18.45 | 0.55 | 0.30 | 45 | 0.40 | 0.75 |

TABLE 5

| No | α lead angle | h rib height mm | p3 rib pitch mm | recess profile | recess jutting-out | protrusion profile | protrusion jutting-out |
|---|---|---|---|---|---|---|---|
| 1-1 | 43 | 0.27 | 5.1 | triangle | no | triangle | no |
| 1-2 | 43 | 0.26 | 5.1 | triangle | yes | triangle | no |
| 1-3 | 43 | 0.27 | 5.1 | triangle | yes | triangle | yes |
| 1-4 | 43 | 0.27 | 5.1 | triangle | yes | trapezoid | yes |
| 1-5 | 43 | 0.27 | 5.1 | trapezoid | yes | trapezoid | yes |
| 1-6 | 43 | 0.27 | 5.1 | trapezoid | yes | trapezoid | yes |
| 1-7 | 43 | 0.27 | 5.1 | trapezoid | yes | trapezoid | yes |
| 1-8 | 43 | 0.27 | 5.1 | trapezoid | yes | trapezoid | yes |
| 1-9 | 43 | 0.27 | 5.1 | trapezoid | yes | trapezoid | yes |
| 1-10 | 43 | 0.27 | 5.1 | trapezoid | yes | trapezoid | yes |
| 1-11 | 43 | 0.27 | 5.1 | trapezoid | yes | trapezoid | yes |
| 1-12 | 43 | 0.27 | 5.1 | trapezoid | yes | trapezoid | yes |
| 1-13 | 43 | 0.27 | 5.1 | trapezoid | yes | trapezoid | yes |
| 1-14 | 43 | 0.27 | 5.1 | trapezoid | yes | trapezoid | yes |
| 1-15 | 43 | 0.27 | 5.1 | trapezoid | yes | trapezoid | yes |
| 1-16 | 43 | 0.27 | 5.1 | trapezoid | yes | trapezoid | yes |
| 1-17 | 43 | 0.27 | 5.1 | trapezoid | yes | trapezoid | yes |

TABLE 6

| No | α lead angle | h rib height mm | p3 rib pitch mm | recess profile | recess jutting-out | protrusion profile | protrusion jutting-out |
|---|---|---|---|---|---|---|---|
| 1-18 | 43 | 0.27 | 5.1 | trapezoid | yes | trapezoid | yes |
| 1-19 | 43 | 0.27 | 5.1 | trapezoid | yes | trapezoid | yes |
| 1-20 | 43 | 0.27 | 5.1 | trapezoid | yes | trapezoid | yes |
| 1-21 | 43 | 0.27 | 5.1 | trapezoid | yes | trapezoid | yes |
| 1-22 | 41 | 0.27 | 5.1 | trapezoid | yes | trapezoid | yes |
| 1-23 | 44 | 0.27 | 5.1 | trapezoid | yes | trapezoid | yes |
| 1-24 | 47 | 0.27 | 5.1 | trapezoid | yes | trapezoid | yes |
| 1-25 | 50 | 0.27 | 5.1 | trapezoid | yes | trapezoid | yes |
| 1-26 | 43 | 0.22 | 5.1 | trapezoid | yes | trapezoid | yes |
| 1-27 | 43 | 0.30 | 5.1 | trapezoid | yes | trapezoid | yes |
| 1-28 | 43 | 0.35 | 5.1 | trapezoid | yes | trapezoid | yes |
| 1-29 | 43 | 0.45 | 5.1 | trapezoid | yes | trapezoid | yes |
| 1-30 | 43 | 0.27 | 2.7 | trapezoid | yes | trapezoid | yes |
| 1-31 | 43 | 0.27 | 3.0 | trapezoid | yes | trapezoid | yes |
| 1-32 | 43 | 0.27 | 4.1 | trapezoid | yes | trapezoid | yes |

TABLE 6-continued

| No | α lead angle | h rib height mm | p3 rib pitch mm | recess profile | recess jutting-out | protrusion profile | protrusion jutting-out |
|---|---|---|---|---|---|---|---|
| 1-33 | 43 | 0.27 | 6.1 | trapezoid | yes | trapezoid | yes |
| 1-34 | 43 | 0.27 | 6.5 | trapezoid | yes | trapezoid | yes |

TABLE 7

| No | α lead angle | h rib height mm | p3 rib pitch mm | recess profile | recess jutting-out | protrusion profile | protrusion jutting-out |
|---|---|---|---|---|---|---|---|
| 2-1 | 43 | 0.27 | 5.1 | trapezoid | yes | trapezoid | yes |
| 2-2 | 43 | 0.27 | 5.1 | trapezoid | yes | trapezoid | yes |
| 2-3 | 43 | 0.27 | 5.1 | trapezoid | yes | trapezoid | yes |
| 2-4 | 43 | 0.27 | 5.1 | trapezoid | yes | trapezoid | yes |
| 2-5 | 43 | 0.27 | 5.1 | trapezoid | yes | trapezoid | yes |
| 2-6 | 43 | 0.27 | 5.1 | trapezoid | yes | trapezoid | yes |
| 2-7 | 43 | 0.27 | 5.1 | trapezoid | yes | trapezoid | yes |
| 2-8 | 43 | 0.27 | 5.1 | trapezoid | yes | trapezoid | yes |
| 2-9 | 43 | 0.27 | 5.1 | trapezoid | yes | trapezoid | yes |
| 2-10 | 43 | 0.27 | 5.1 | trapezoid | yes | trapezoid | yes |
| 2-11 | 43 | 0.27 | 5.1 | trapezoid | yes | trapezoid | yes |
| 2-12 | 40 | 0.27 | 5.1 | trapezoid | yes | trapezoid | yes |
| 2-13 | 52 | 0.27 | 5.1 | trapezoid | yes | trapezoid | yes |
| 2-14 | 43 | 0.20 | 5.1 | trapezoid | yes | trapezoid | yes |
| 2-15 | 43 | 0.47 | 5.1 | trapezoid | yes | trapezoid | yes |
| 2-16 | 43 | 0.27 | 2.4 | trapezoid | yes | trapezoid | yes |
| 2-17 | 43 | 0.27 | 7.0 | trapezoid | yes | trapezoid | yes |

TABLE 8

| No. | Ki (overall heat transfer coefficient) kcal/m$^2$ · h · ° C. |
|---|---|
| 1-1 | shown in FIG. 5 |
| 1-2 | shown in FIG. 5 |
| 1-3 | shown in FIG. 5 |
| 1-4 | shown in FIG. 5 |
| 1-5 | 6978.8 |
| 1-6 | 6975.5 |
| 1-7 | 6962.5 |
| 1-8 | 6981.3 |
| 1-9 | 6971.5 |
| 1-10 | 6968.6 |
| 1-11 | 6990.2 |
| 1-12 | 6977.5 |
| 1-13 | 6972.1 |
| 1-14 | 6975.6 |
| 1-15 | 6983.4 |
| 1-16 | 6981.9 |
| 1-17 | 6984.6 |

TABLE 9

| No. | Ki (overall heat transfer coefficient) kcal/m$^2$ · h · ° C. |
|---|---|
| 1-18 | 6989.4 |
| 1-19 | 6984.9 |
| 1-20 | 6979.3 |
| 1-21 | 6978.6 |
| 1-22 | 6978.5 |
| 1-23 | 6981.0 |
| 1-24 | 6979.2 |
| 1-25 | 6976.5 |
| 1-26 | 6987.3 |
| 1-27 | 6986.2 |

TABLE 9-continued

| No. | Ki (overall heat transfer coefficient) kcal/m$^2$ · h · ° C. |
|---|---|
| 1-28 | 6982.9 |
| 1-29 | 6990.3 |
| 1-30 | 6967.5 |
| 1-31 | 6975.6 |
| 1-32 | 6983.4 |
| 1-33 | 6971.3 |
| 1-34 | 6975.6 |

TABLE 10

| No. | Ki (overall heat transfer coefficient) kcal/m$^2$ · h · ° C. |
|---|---|
| 2-1 | 5852.5 |
| 2-2 | 5649.3 |
| 2-3 | 5112.6 |
| 2-4 | 5168.3 |
| 2-5 | 6023.4 |
| 2-6 | 5983.4 |
| 2-7 | 6053.1 |
| 2-8 | 5864.5 |
| 2-9 | 6320.1 |
| 2-10 | 6315.5 |
| 2-11 | 5984.7 |
| 2-12 | 6284.9 |
| 2-13 | 6340.4 |
| 2-14 | 6178.3 |
| 2-15 | 6195.7 |
| 2-16 | 6134.2 |
| 2-17 | 5998.4 |

As described above, by adoption of a boiling heat transfer tube according to the present invention, even when a low density refrigerant is used, boiling heat transfer can efficiently be accelerated and a boiling heat transfer tube with an excellent heat transfer performance can be achieved. Accordingly, the present invention can realize performance improvement of a heat exchanger, size and weight reduction, decrease in number of members in use, reduction in refrigerant charge, and efficiency improvement of a refrigerator or the like.

What is claimed is:

1. A boiling heat transfer tube comprising: a heat transfer tube body; and fins formed on an outer surface of the tube body in a specified pitch along an axial direction thereof while being disposed in an extending manner along tube peripheral directions, wherein each of fins has recesses and protrusions disposed alternately, a protrusion coming after a recess or vice versa, along its length direction and an opening width (W) between protrusions of adjacent fins is 0.13 mm<W≦0.40 mm.

2. A boiling heat transfer tube according to claim 1, wherein the opening width at a top end of a cavity between an adjacent pair of the fins is narrowed by inward jutting-out of the fins at one of the recesses and protrusions.

3. A boiling heat transfer tube according to claim 2, wherein a profile of each of the protrusions in section perpendicular to the tube axis assumes a trapezoid.

4. A boiling heat transfer tube according to claim 3, wherein in a section perpendicular to the tube axis, an angle (θ) formed between opposed side surfaces of each recess is 55 degrees or less.

5. A boiling heat transfer tube according to claim 4, wherein in a section perpendicular to the tube axis, a pitch (P1) of the recesses or the protrusions in a peripheral direction is 0.28 mm≦P1≦0.55 mm.

6. A boiling heat transfer tube according to claim 5, wherein in a section including the tube axis, a pitch (P2) of the cavities is 0.50 mm≦P2≦0.90 mm.

7. A boiling heat transfer tube according to claim 1, wherein ribs are provided on an inner surface of the tube body in a spiral fashion.

8. A boiling heat transfer tube according to claim 7, wherein the ribs have a rib lead angle (α) to the tube axis in the range of 41 degrees≦α≦50 degrees, a rib height (h) in the range of 0.22 mm≦h≦0.45 mm and a rib pitch (P3) in a tube axial direction in the range of 2.6 mm≦P3≦6.5 mm.

* * * * *